US008844945B2

(12) United States Patent
Koyess et al.

(10) Patent No.: US 8,844,945 B2
(45) Date of Patent: Sep. 30, 2014

(54) ICE SKATE RUNNER

(75) Inventors: Philippe Koyess, Lachine (CA); Alexandre Chretien, Laval (CA)

(73) Assignee: Sport Maska Inc., Montreal, Quebec ( * ) Notice: Subject to any disclaimer, the term of this patent is extended or adjusted under 35 U.S.C. 154(b) by 745 days.

(21) Appl. No.: 12/593,781

(22) PCT Filed: Mar. 28, 2008

(86) PCT No.: PCT/CA2008/000599

§ 371 (c)(1), (2), (4) Date: Mar. 3, 2010

(87) PCT Pub. No.: WO2008/119174

PCT Pub. Date: Oct. 9, 2008

(65) Prior Publication Data

US 2010/0176564 A1 Jul. 15, 2010

Related U.S. Application Data

(60) Provisional application No. 60/907,337, filed on Mar. 29, 2007, provisional application No. 60/924,634, filed on May 23, 2007, provisional application No. 60/924,706, filed on May 29, 2007, provisional application No. 61/016,068, filed on Dec. 21, 2007.

(51) Int. Cl.
*A63C 1/00* (2006.01)
*A63C 1/32* (2006.01)

(52) U.S. Cl.
CPC ..... *A63C 1/32* (2013.01)
USPC ..... 280/11.18; 280/11.12

(58) Field of Classification Search
CPC ..... A63C 1/30; A63C 1/32; A63C 1/303
USPC ..... 280/811, 841, 11.12, 11.18, 11.14, 280/11.15, 11.17
See application file for complete search history.

(56) References Cited

U.S. PATENT DOCUMENTS

| | | | |
|---|---|---|---|
| 1,115,790 | A | 11/1914 | Drevitson |
| 1,319,094 | A | 10/1919 | Kerrigan |
| 3,212,786 | A | 10/1965 | Florjancic et al. |
| 3,558,149 | A | 1/1971 | Weidenbacker |
| 3,866,927 | A | 2/1975 | Tvengsberg |
| 3,934,892 | A | 1/1976 | Baikie |
| 3,954,278 | A | 5/1976 | McLeod |

(Continued)

FOREIGN PATENT DOCUMENTS

| | | |
|---|---|---|
| CA | 1213916 | 11/1986 |
| CA | 1314913 | 3/1993 |

(Continued)

*Primary Examiner* — John Walters
*Assistant Examiner* — Brian Swenson
(74) *Attorney, Agent, or Firm* — Norton Rose Fulbright Canada

(57) ABSTRACT

An ice skate runner for engagement in a blade holder of an ice skate, the blade holder having an opening defined along a bottom edge thereof and fastening means to retain the runner. The runner comprises an upper polymeric portion shaped to be partially received within the opening of the holder and defining a major part of the runner, a lower portion having a greater density than that of the upper portion and defining a lower blade surface for engaging the ice. At least one of the upper and lower portions is shaped to removably engage the fastening means.

31 Claims, 5 Drawing Sheets

(56) References Cited

U.S. PATENT DOCUMENTS

| | | | | |
|---|---|---|---|---|
| 3,967,832 | A * | 7/1976 | Chambers | 280/11.12 |
| 4,053,168 | A | 10/1977 | Goverde | |
| 4,088,335 | A | 5/1978 | Norton et al. | |
| 4,093,249 | A | 6/1978 | Chambers | |
| 4,223,900 | A | 9/1980 | Olivieri | |
| 4,251,086 | A | 2/1981 | Woolley | |
| 4,314,708 | A | 2/1982 | Zuuring | |
| 4,336,948 | A | 6/1982 | Couture | |
| 4,351,537 | A | 9/1982 | Seidel | |
| 4,549,742 | A | 10/1985 | Husak | |
| 4,744,574 | A | 5/1988 | Soo | |
| 4,907,813 | A | 3/1990 | Hall | |
| 5,257,793 | A | 11/1993 | Fortin | |
| 5,332,242 | A | 7/1994 | Cann et al. | |
| 5,360,227 | A | 11/1994 | Lemelson | |
| 5,484,148 | A | 1/1996 | Olivieri | |
| D373,399 | S | 9/1996 | Both | |
| 5,769,434 | A | 6/1998 | Wurthner | |
| 5,988,683 | A | 11/1999 | Venier et al. | |
| 6,039,328 | A | 3/2000 | Pawlowski et al. | |
| 6,105,975 | A | 8/2000 | Shum | |
| 6,109,622 | A | 8/2000 | Reynolds | |
| 6,485,033 | B2 | 11/2002 | Nicoletti | |
| 6,761,363 | B2 * | 7/2004 | Fask et al. | 280/11.18 |
| 7,866,675 | B2 * | 1/2011 | Hauser | 280/11.18 |
| 2005/0029755 | A1 | 2/2005 | Fask et al. | |
| 2009/0273148 | A1 * | 11/2009 | Wan | 280/11.18 |
| 2011/0001297 | A1 * | 1/2011 | Labont et al. | 280/11.12 |

FOREIGN PATENT DOCUMENTS

| | | |
|---|---|---|
| CA | 2087551 | 7/1993 |
| CA | 2145520 | 4/1994 |
| CA | 2169106 | 8/1997 |
| CA | 2243195 | 1/1999 |
| CA | 2423049 | 3/2002 |
| DE | 3228460 | 2/1984 |
| DE | 3326154 | 6/1984 |
| EP | 0060722 | 9/1982 |
| EP | 0248956 | 6/1990 |

* cited by examiner

ICE SKATE RUNNER

CROSS-REFERENCE TO RELATED APPLICATIONS

This application claims priority on U.S. Provisional Patent Application Nos. 60/907,337 filed on Mar. 29, 2007; 60/924,634 filed on May 23, 2007; 60/924,706 filed May 29, 2007; and 61/016,068 filed on Dec. 21, 2007 which are incorporated by reference.

FIELD OF THE INVENTION

The present object relates to sports equipment with blades, and in particular to ice skates having replaceable blades.

BACKGROUND ART

As skate boots are generally more durable than skate blades, also known as runners, it is known to provide skates with planar steel blades detachably received within a holder of the skate, such that the blades can be easily replaced when worn out. However, such steel blades are generally heavy and represent a significant part of the weight of the skate.

As the performance of a skate can be substantially influenced by its weight, a number of skate and blade designs have been created with the goal of minimizing the weight of the skate. Skates having thin metal blades retained in special holders and/or special fastening means have been designed. However, the necessity for the special holders and/or fastening means generally prevents such blade improvements to be used on more conventional skates having holders manufactured to receive standard, typical planar steel blades.

U.S. Pat. No. 6,761,363 issued Jul. 13, 2004 to Fask et al. shows a runner formed by injection molding a steel insert blade, producing a runner which is lighter than an all-steel runner of similar size and shape. However, as the steel portion of the blade extends through almost the entire runner, the runner is still relatively heavy.

Canadian Patent No. 2,423,049 discloses a runner formed by inserted injection molding a recessed steel insert blade. A polymeric material portion extends forwardly from a portion of the upper edge of the blade and covers at least a portion of recessed regions of the metal blade, which is formed having lips or recesses therein for being able to accommodate the polymeric portion along the length of the blade.

Accordingly, improvements are desirable. While replaceable and interchangeable skate blades are known, improvements are nonetheless desirable. In particular, a runner which is simpler and therefore less costly to manufacture is desired, as is one which is even less heavy than those already known in the art. It is also desirable to be able to provide for a skate wherein standard or traditional plastic holders can be used with a new, lightweight runner having a reduced amount of steel and yet still being configured and disposed so as to fit inside the standard holder on any number of types of skates without requiring modification of the holder or replacement thereof.

SUMMARY OF INVENTION

It is therefore an aim of the present description to provide an improved ice skate runner.

Therefore, in accordance with an aspect of the present invention, there is provided an ice skate runner for detachable engagement in a blade holder of an ice skate, the blade holder having an opening therein for receiving at least a portion of the runner and mounting points to retain the runner in place, the runner comprising: an upper polymeric portion shaped to be partially received within the opening of the blade holder, the upper polymeric portion defining a major part of the runner; a lower portion having a greater density than that of the upper portion and defining a blade surface for engaging the ice; and at least one of the upper and lower portions being shaped to removably engage the mounting points.

In accordance with another aspect of the present invention, there is also provided an ice skate comprising: a skate boot; a holder having a top surface attached to an underside of the skate boot and a bottom surface with an elongated opening defined therein and front and rear mounting points; and a replaceable runner detachably engaged to the holder at said front and rear mounting points and having a portion thereof received within the elongated opening, the runner having a metal blade and an upper polymeric portion fixed to the blade along an elongated body of the blade, the elongated body extending between front and rear curved ends, two mounting members being upstanding from the elongated body and disposed proximate the front and rear curved ends, the mounting members being engaged with the front and rear mounting points of the holder for detachably fastening the runner thereto, the upper polymeric portion including a central upper ridge which is received within the elongated opening of the holder and defining a slot formed in a base thereof within which at least a portion of the blade body is received, and wherein a first height of the polymeric portion above the blade is greater than a second height of the polymeric portion which overlaps the blade.

In accordance with a further aspect of the present invention, there is provided a replaceable runner for an ice skate comprising: a metal blade having an elongated body extending between front and rear curved ends, at least one mounting member disposed on the elongated body proximate each of the front and rear curved ends, the mounting members being configured for fastening engagement with the ice skate; and an upper polymeric portion fixed to the blade along the elongated body thereof, the upper polymeric portion having a slot defined in a base thereof within which at least a portion of the blade body is received, and wherein a first height of the polymeric portion above the blade is greater than a second height of the polymeric portion which overlaps the blade.

Also in accordance with alternate aspects, there is provided an ice skate runner for engagement in a holder of an ice skate designed to receive a planar steel blade therein, the runner having an engagement portion shaped to be received and retained within the holder and a lower blade surface for engaging the ice, the lower blade surface being made of a first material, a major part of the engagement portion being made of a second material and free of the first material, the second material having a lower density than that of the first material.

Further in accordance with further alternate aspects, there is provided an ice skate runner for detachable engagement with a holder of an ice skate, the runner including a lower portion having a constant thickness and defining a lower blade surface for engaging the ice, and an upper portion partially surrounding the lower portion and permanently connected thereto, the upper portion being shaped to removably engage the holder and having a lower density than that of the lower portion.

BRIEF DESCRIPTION OF THE DRAWINGS

Reference will now be made to the accompanying drawings, showing by way of illustration a particular embodiment of the present disclosure and in which.

DETAILED DESCRIPTION OF PARTICULAR EMBODIMENTS

Figure 1:
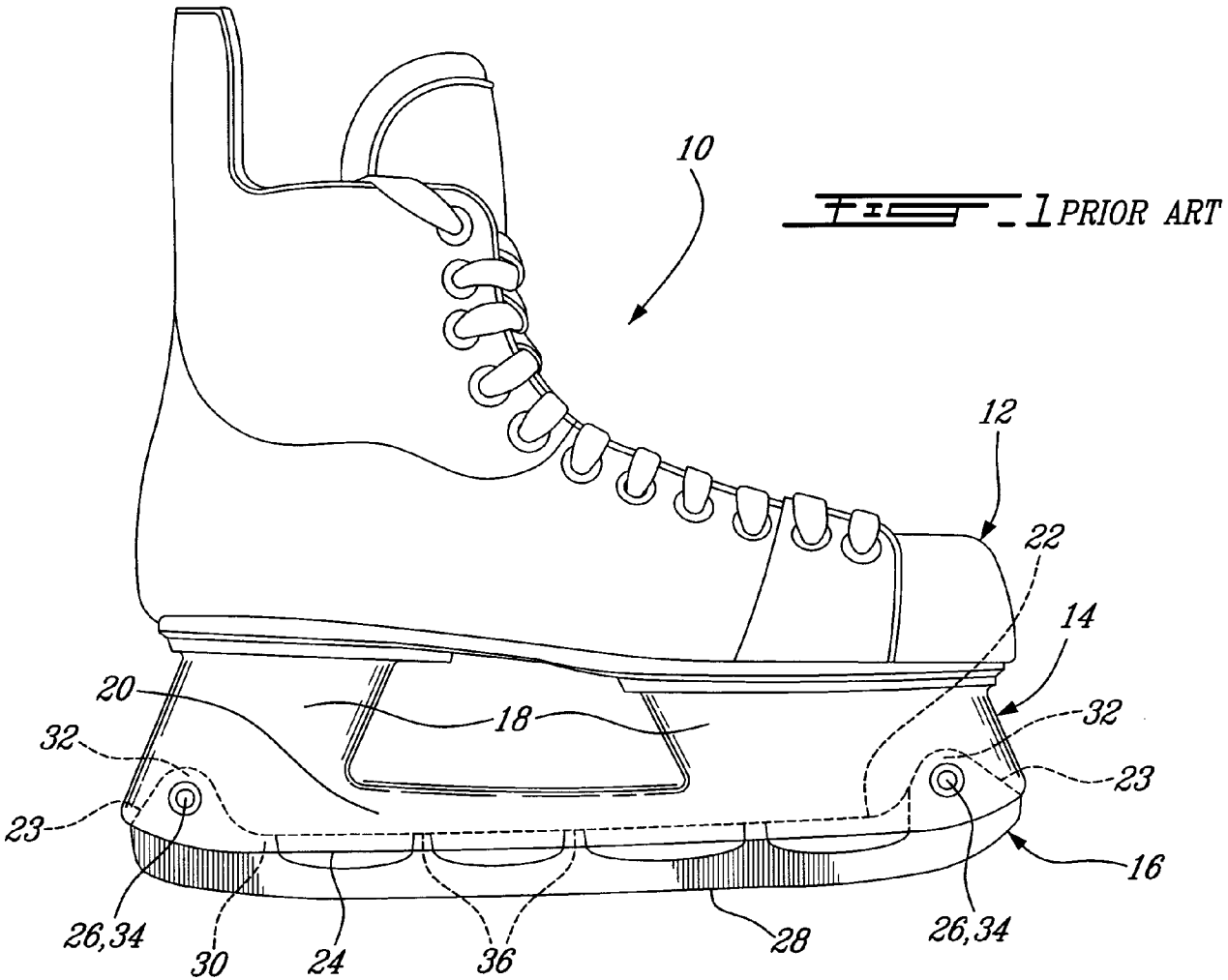
FIG. 1 PRIOR ART
FIG. 1 is a side, schematic view of an ice skate according to the prior art.

Referring to FIG. 1, a typical ice skate is generally shown at 10. The skate 10 comprises a skate boot 12 adapted to receive a foot therein, a blade holder 14 attached under the boot 12, and a replaceable blade 16 received within the holder 14. The holder 14 includes attachment portions 18 extending from the skate boot 12 and a bottom portion 20 extending between the attachment portions 18 along the length of the skate 10. The attachment portions 18 and the bottom portion 20 include a vertically extending elongated slot 22 defined in a bottom surface 24 thereof, which can be machined into the holder 14 or alternately integrally molded therewith. The slot 22 does not comprise any reinforcing material, such as steel, aluminum, composite materials, or others. The attachment portions 18 each include fastening means, which in the embodiment shown include the slot 22 having enlarged, rounded ends 23 in each attachment portion 18, and a hole 26 defined through each attachment portion 18 across the rounded ends 23 of the slot 22.

The blade 16 of the skate 10 is usually made of stainless steel and generally has a planar shape, i.e. a constant thickness. The blade 16 has a bottom surface 28 having sharp bottom edges such as to slide on ice, and a top portion 30 including front and rear fastening tabs 32 having a rounded shape conforming to the rounded ends 23 of the slot 22 and each having a hole 34 defined therethrough. The top portion 30 of the blade 16 also includes a plurality of spaced apart upwardly extending fingers 36. In use, the fingers 36 and the fastening tabs 32 are received within the elongated slot 22 of the holder 14 and each hole 34 of the blade 16 is aligned with the corresponding hole 26 of the holder 14. Alternately, the top portion 30 may define a generally straight edge in between the fastening tabs 32 which is received within the slot 22. An adequate fastener, such as for example a screw and bolt assembly (not shown), is received within each set of aligned holes 26, 34 to retain the blade 16 within the elongated slot 22.

The skate 10 shown in FIG. 1 is one example of a known skate. It should be kept in mind that the runner described herein can be used with a number of alternate types of skates, for example having a holder with alternate fastening means.

Figure 2:
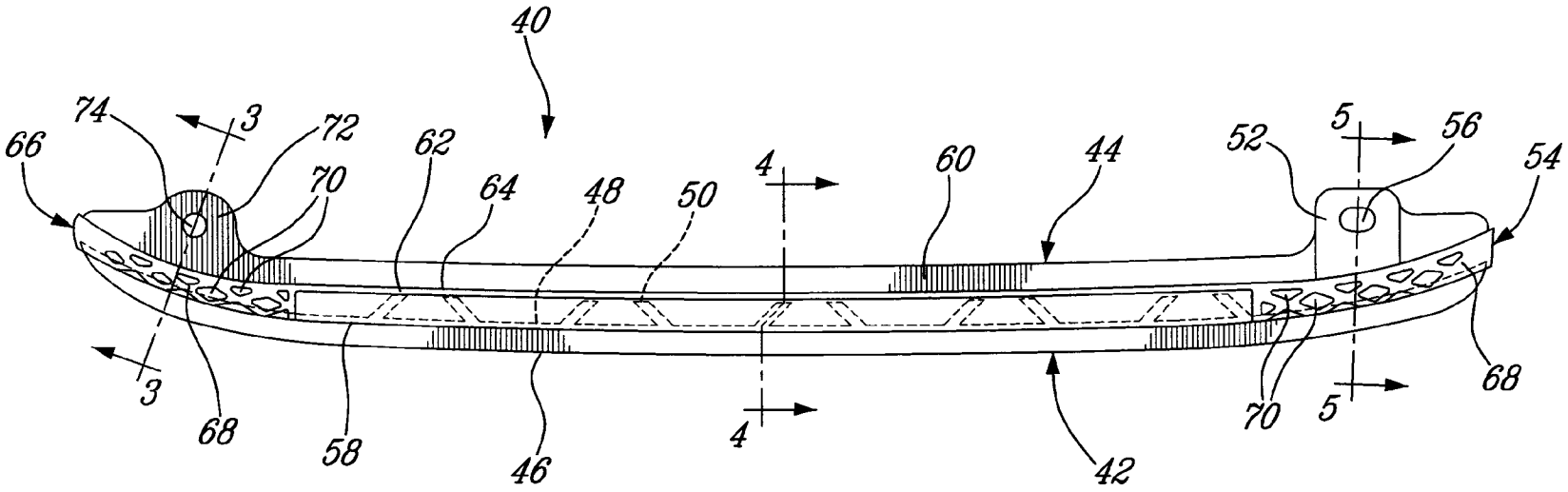
FIG. 2 is a side, schematic view of a runner according to a particular embodiment, which can be used in a skate such as shown in FIG. 1.

Referring to FIG. 2, a runner 40 according to a particular embodiment is shown. The runner 40 is designed to replace the blade 16 shown in FIG. 1, without requiring changes to the holder 14 of the skate 10. Additionally, the configuration of the runner 40 preferably allows for the runner 40 to be sharpened using standard equipment typically used to sharpen usual flat steel blades such as the one shown at 16 in FIG. 1.

The runner 40 includes a lower portion 42 which is partially encased in an upper portion 44, with the upper portion 44 having a lower density than that of the lower portion 42. In a particular embodiment, the lower portion 42 is made of steel, and the upper portion 44 is made of an appropriate type of plastic or fiber-reinforced plastic, such as for example nylon reinforced with 14% to 30% of fiberglass.

The lower portion 42 includes a bottom surface 46 having sharp bottom edges such as to slide on ice, and an opposed top surface 48. As also shown in FIG. 4, the top surface 48 includes a series of angled fingers 50 protruding therefrom and encased within the upper portion 44.

Figure 5:
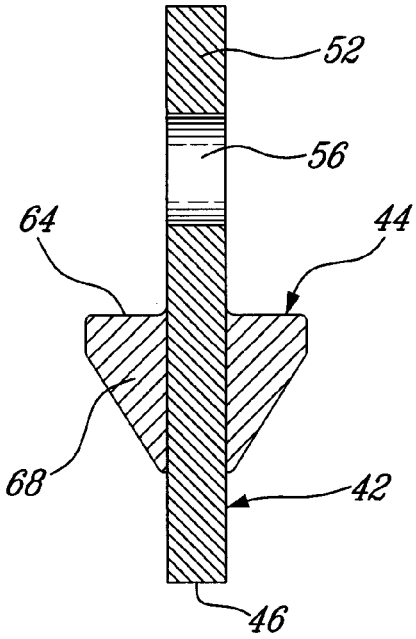
FIG. 5 is a cross-sectional, schematic view of the runner of FIG. 2 taken along line 5-5.
Figure 6:
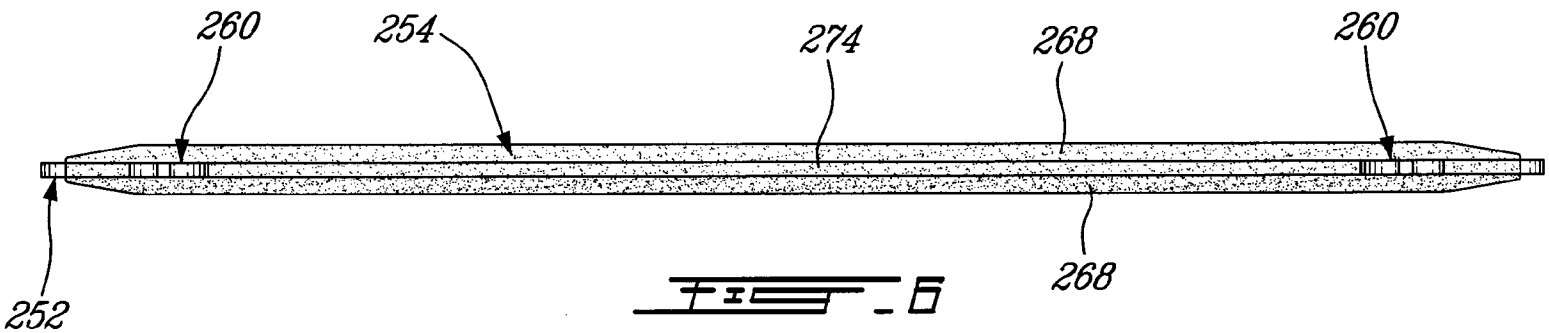
FIG. 6 is a top, schematic view of an alternate runner in accordance with another embodiment, which can be used with the skate of FIG. 1.

Referring to FIGS. 2 and 5, the lower portion 42 also includes a rear fastening member, which in the embodiment shown is in the form of a rear fastening tab 52 having a rounded shape conforming to the corresponding rounded end 23 of the holder slot 22. The rear fastening tab 52 extends upwardly from the top surface 48 of the lower portion 42 through and beyond the upper portion 44, in proximity of a rear end 54 of the runner 40. The rear fastening tab 52 includes a slot 56 defined therein.

In the embodiment shown, the lower portion 42 has a constant thickness, such as to minimize the machining operations necessary to its manufacture.

Figure 4:
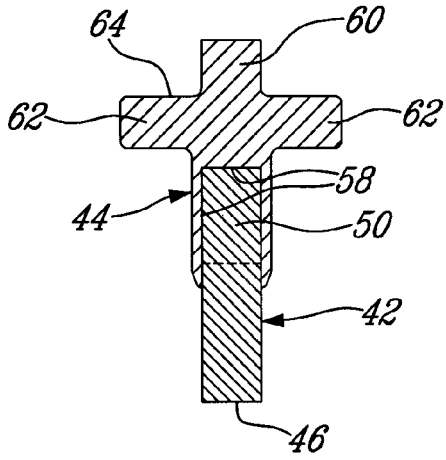
FIG. 4 is a cross-sectional, schematic view of the runner of FIG. 2 taken along line 4-4.

Referring to FIGS. 2 and 4, the upper portion 44 includes a bottom surface 58 contouring and engaging the top surface 48 of the lower portion 42, and surrounding the rear fastening tab 52. The upper portion 44 also includes an upwardly extending elongated tab 60 sized and shaped to be received within the holder slot 22. The upper portion 44 further includes a lateral ridge 62 extending along the length of the runner 40 on each side of the elongated tab 60, and protruding beyond the lower portion 42. The lateral ridges 62 each define a top surface 64 abutting the bottom surface 24 of the holder 14 when the elongated tab 60 is received within the holder slot 22. The lateral ridges 62 help reinforce the upper portion 44 such that the upper portion 44 can define a greater part of the runner 40.

Figure 3:
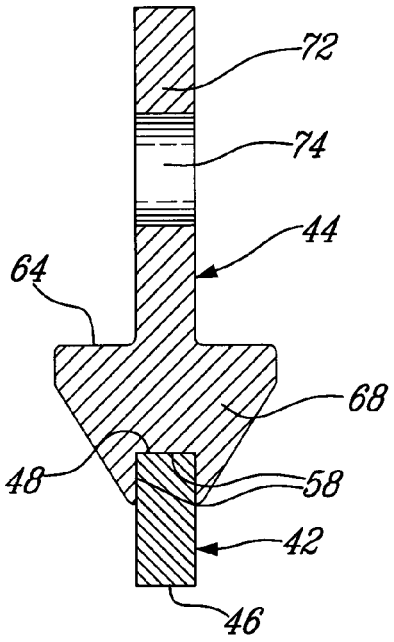
FIG. 3 is a cross-sectional, schematic view of the runner of FIG. 2 taken along line 3-3.

Referring to FIGS. 2, 3 and 5, the upper portion 44 optionally includes reinforcement portions 68 under the lateral ridges 62 near the rear end 54 and the front end 66 of the runner 40, the reinforcement portions 68 having a substantially triangular cross-section and providing additional material at the ends 54, 66 to improve the resistance of the upper portion 44. Indentations 70 (see FIG. 2) are preferably provided on the surface of the reinforcement portions 68 such as to reduce the weight thereof. Alternately, the reinforcement portions 68 can be omitted.

Referring to FIGS. 2 and 3, the upper portion 44 further includes a front fastening member, which in the embodiment shown is in the form of a front fastening tab 72 having a rounded shape conforming to the corresponding rounded end 23 of the holder slot 22. The front fastening tab 72 extends upwardly from the elongated tab 60 of the upper portion 44 near the front end 66 of the runner 40. The front fastening tab 72 includes a hole 74 defined therein.

The rear and front fastening tabs 52, 72 together with the elongated tab 60 define a engagement portion of the runner 40, which is sized and shaped to be received within the slot 22 of the holder 14, with the slot 56 and hole 74 defined in the tabs 52, 72 being sized and positioned such as to be aligned with the holes 26 of the attachment portions 18 of the blade holder 14, so that adequate fasteners can extend through the aligned holes and slot 26, 56, 74.

The shape of the engagement portion can thus vary depending on the geometry of the particular blade holder 14 which is to receive the runner 40. For example, the front and rear fastening tabs 52, 72 can be replaced by any other adequate front and rear fastener member, for example hooks, posts having vertically extending threaded bores defined therein to receive a threaded fastener, tabs having alternate configurations, etc. In addition or alternately, the elongated tab 60 can include one or more fingers protruding therefrom to conform to the shape of the slot 22.

In addition, if the material of the upper portion 44 has sufficient strength, the rear fastener member can alternately be defined by the upper portion 44, thus further reducing the volume of the lower portion 42 and as such the weight of the runner 40.

Also, the front or both fastener members can be at least partly defined by the lower portion 42, although this would result in a slightly heavier runner 40.

In a particular embodiment, the lower portion 42 is machined and inserted in a mold, and the upper portion 44 is molded around the lower portion 42 such that the two portions 42, 44 are permanently bonded. The angled fingers 50 of the lower portion 42 ensure that the lower portion 42 is properly retained within the upper portion 44. Alternately, the angled fingers 50 can be replaced by any other appropriate retaining feature.

It can be seen that the contact between the lower and upper portions 42, 44 is minimal, although sufficient to ensure proper bonding between the two portions 42, 44. The fraction of the runner 40 defined by the lower portion 42 is minimized, thus providing for a runner 40 having a reduced weight since the upper portion 44 has a lower density, and preferably a significantly lower density, than that of the lower portion 42.

In a particular embodiment, a major part, i.e. more than half, of the volume of the runner 40 is defined by the upper portion 44. In addition, a major part of the engagement portion (i.e. fastening tabs 52, 72 and elongated tab 60) of the runner 40 is defined by the upper portion 44 alone, i.e. is free of the material forming the lower portion 42.

The runner 40 allows for significant weight reduction of the overall skate 10, when compared to the same skate 10 equipped with a typical all-steel blade. For example, in a particular embodiment, the runner 40 weights approximately 35-50 g less than a typical, all-steel flat runner or blade 16. Such a weight reduction represents a substantial advantage in the overall performances of the skate 10, without any modifications to the skate boot 12.

Figure 7:
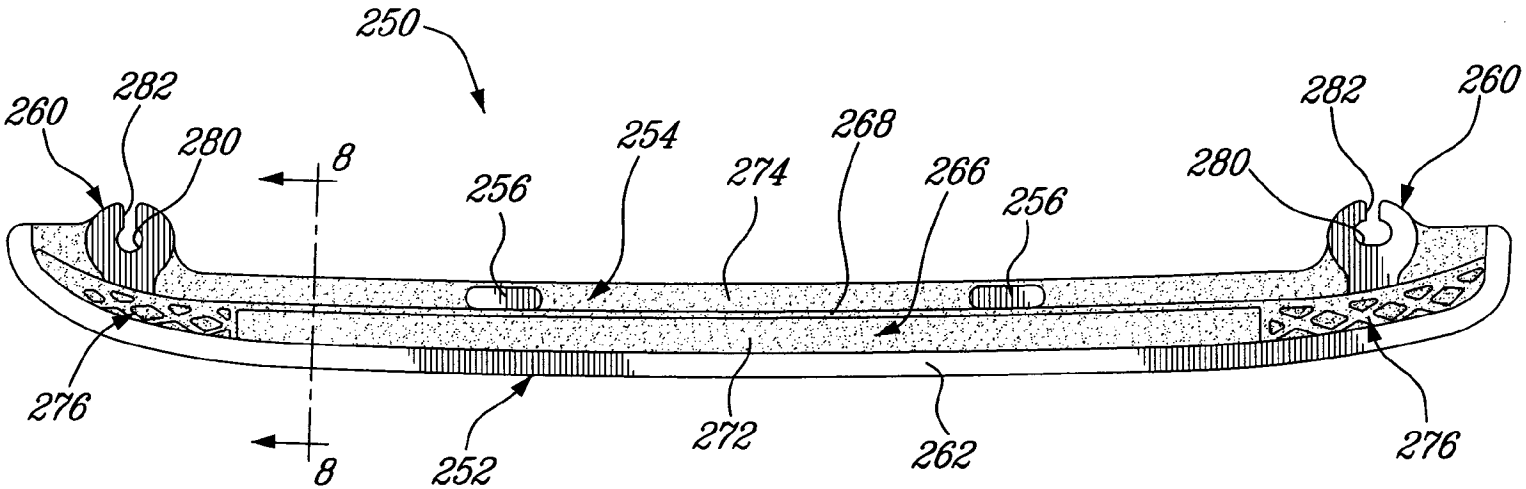
FIG. 7 is a side view of the runner of FIG. 6.

Reference will now be made to FIGS. 6-9 which depict a runner 250 in accordance with an alternate embodiment. As best seen in FIG. 7, the runner 250 includes a metal blade portion 252 which extends the length of the runner and an upper plastic or polymeric portion 254 which is fixed to the metal blade 252 during manufacture of the runner. The runner 250 is designed and sized such as to fit within a "standard" prior art elongated slot 22 of a "standard" prior art holder 14 of a skate 10, such as that shown in FIG. 1 for example, in order to replace an existing all-steel blade 16.

Figure 8:
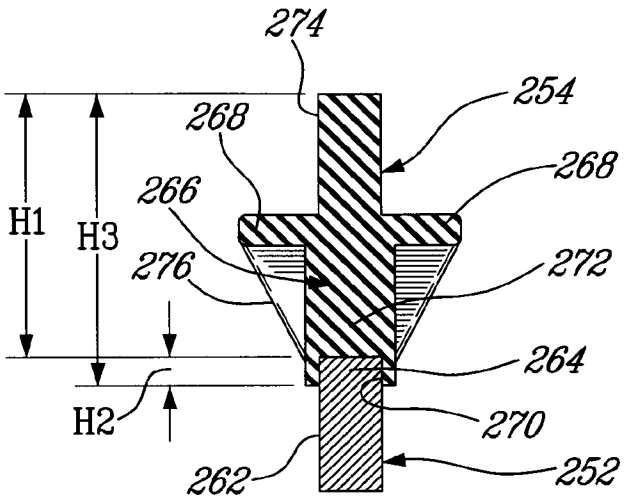
FIG. 8 is a cross-sectional view taken through line 8-8 in FIG. 7.
Figure 9:
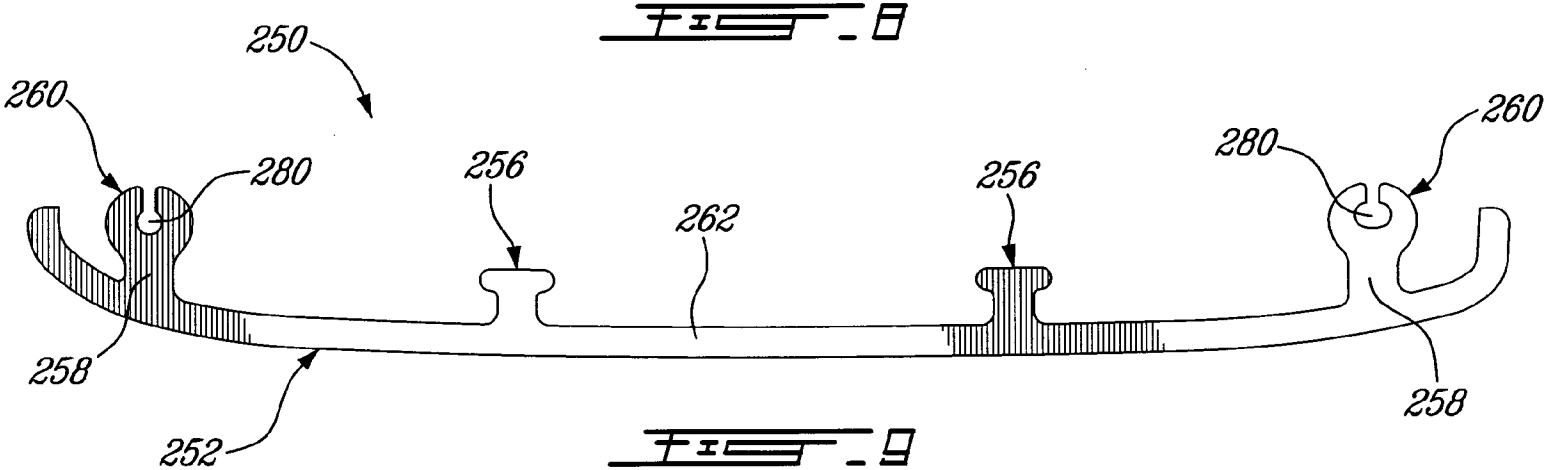
FIG. 9 is a side view of the metal blade portion of the runner of FIG. 6.

The runner 250 described herein is even lighter than other two-material replaceable runners, and is significantly lighter than the all-steel blade 16. More particularly, the runner 250 has significantly less steel (or other metal) than known prior art runners, as the blade portion 252 is further reduced in size without negatively affecting the strength of the runner. The runner 250 has very little overlapping (i.e. polymeric over metal) area. In other words, and as best seen in FIG. 9 which depicts the metal portion 252 of the runner 250 by itself, the only major portions of the metal blade 252 which are overlapped and covered by upper polymeric portion 254 are the two upstanding tongues 256 along the middle portion of the blade's length and the neck portions 258 of the two attachment members 260 disposed proximate each end of the blade. The rest of the blade 252, including the main elongated blade body 262, remains substantially uncovered by the polymeric portion 254 when it is engaged to the metal blade 252 during the manufacturing process. As best seen in FIG. 8, only a very narrow region 264 (in both transversal width and vertical height) of the elongated blade body 262 metal blade 252 is covered by the upper polymeric portion 254 along most of the length of the runner 250.

The mounting members 260 of the blade 252 provide the mounting points at which the entire runner 250 is releasably fastened to the holder 14 of a skate 10. Each of the mounting members 260 includes an opening 280 therein which is adapted to receive a fastener (such as a bolt or other suitable fastening device) used to fasten the runner 250 to the skate's blade holder 14. As best seen in FIG. 7, the openings 280 are not, in at least the depicted embodiment, closed holes (i.e. they have slots 282 which communicate with the openings 280), which permit a fastener or other mating component to be slid into the opening 280 without having to be lined up and fed transversally through the skate holder and the openings 280 in order to fix the runner to the skate holder. This simplifies the installation process of the runner 250 to a skate. Particularly, the given shape of mounting members 260 and the openings 280 therein permit only as single one of the mounting members 260 to require fastening (such as with a bolt) to the holder of the skate. Particularly, the front mounting member may be engaged with a corresponding pin or the like, and then the rest of the runner pivoted rearwardly into position within the elongated slot 22 of the holder 14. Once in position, the rear mounting member 260 can then be securely fastened to the holder, such as using a bolt for example. This simplifies the installation of the present runner 250 and also cuts down on components, particularly metallic components, thereby further reducing the overall weight of the present runner 250 when releasably engaged to a skate.

Further, the lack of a ridge or lip in the side surfaces of the blade body 262 means that the strength of the metal blade 252 is not compromised, given that the blade 252 has a planar shape, i.e. has a substantially constant transverse thickness at all points thereon. This lack of reduced thickness regions improves the overall strength of the steel blade 252 and therefore the entire runner 250. This further permits the polymeric upper portion 254 to be fixed flush to the side surfaces of the blade, which makes manufacturing easier and therefore reduces the production costs of the runner.

In the present runner 250, the polymeric portion 254 represents a significant part of the entire runner of the runner 250, and thus reduces the total amount of metal required which accordingly significantly reduces the overall weight of the runner 250. Even though the total amount of metal in the runner 250 has been reduced relative to known runners, the present runner 250 has nonetheless been found to be sufficiently strong and therefore resistant to deformation, flex, bending, etc.

As best seen in FIG. 8, in order to provide this strength without a large amount of metal present in the runner 250, the upper polymeric portion 254 of the runner 250 is formed with a T-shaped or cross-shaped cross-sectional profile. More particularly, the polymeric portion 254 includes a center body 266 which extends upwardly from the metal blade 252. Two opposed lateral ridges 268 extend transversely away from the center body 266 and are integrally formed therewith, thus forming the generally cruciform-shaped polymeric portion 254. Other configurations of the polymeric portion 254 are possible, such as T-shaped for example. The upper polymeric portion 254 of the runner 250 as shown has this cruciform-shaped body configuration along a majority of its total longitudinal length, as seen in FIG. 7, namely at least between the two runner mounting members 260.

As is also seen in FIG. 8, the blade only extends a very small vertical distance into the polymeric portion 254, such that a majority of the overall height (i.e. vertical distance) H3 of the polymeric portion 254 is solid polymeric material and does not overly or overlap the metal blade. In other words, a first height H1 of the polymeric portion which extends above to top edge of the blade 252 is greater than a second height H2 of the polymeric portion which extends below this top edge of the blade 252 and therefore which overlaps the blade. As seen in FIG. 8, the first height H1 is in fact preferably significantly greater than the second height H2. This is not true of known prior art runners, in which the metal blade extends almost the entire height of the runner, the upper part of which is overlaid by the polymeric upper which fits into the recesses formed on either side of the blade by the lips in the blade side surfaces.

In the runner of the present embodiment, the first height H1 is significantly greater than the second height H2 at least partially because the slot 270 formed in the base of the polymeric portion 254 has a small depth (i.e. relative to the total height, and that as such only a small amount of the height of the blade; in fact corresponding to the second height H2) can be received within the polymeric portion. The slot 270 formed in the polymeric portion 254 which receives the blade body 262 has a depth which is preferably less than half of a total height of the blade body, and more preferably less than ¼ of the total height of the blade body.

Each of the opposed ends of the polymeric portion 254 include, in at least the present embodiment, a more solid region 276 proximate each of the mounting members 260 of the runner. More particularly, these regions 276 provided added strength to the assembly, without unduly adding significant weight. In order to improve the strength, stiffness and simultaneously reduce the weight of these regions 276 of the polymeric portion 254, they are formed with a "crisscross" (or lattice shaped) configuration.

Referring back to FIG. 8, the lower part 272 of the body 266 of the polymeric portion 254 which mounts to the blade 252 has a width which is slightly larger than that of the metal blade 252, such that the blade can be received within the longitudinally extending slot 270 formed in the underneath surface of the body 266 of the polymeric portion 254. The uppermost part 274 of the body 266 may have the same width as the lower part 272 thereof, or alternately the upper part 274 may be narrower. Openings 278 are formed in the upper part 274 of the polymeric portion 254, through which the metal tongues 256 of the blade 252 are visible.

Further, unlike many of the replaceable runners or blades of the prior art, the present runners 40, 250 are designed and sized to be able to replace any type of ice hockey skate blade, regardless of the type or manufacturer of the skate and/or blade holder. In other words, the present runners 40, 250 are able to be mounted onto any number of different skates, whether the skate is made by a different manufacturer than that of the present runner or not. As such, no modification to the holders of existing skates is necessary in order to be able to accept the present improved skate runners 40, 250 as described herein.

Although the non-metallic portion 48, 254 of the runner 40, 250 is described above as a "polymeric" portion, it is to be understood that this part of the runner can be made of any suitable non-metallic material, whether plastic, composite, etc.

The embodiments described above are intended to be exemplary. Those skilled in the art will therefore appreciate that the foregoing description is illustrative only, and that various alternate configurations and modifications can be devised without departing from the spirit of the present disclosure. Accordingly, the present disclosure is intended to embrace all such alternate configurations, modifications and variances which fall within the scope of the appended claims.

The runners 40 and 250 can thus be advantageously used with conventional skates in replacement of the typical all-steel blade those skates were originally manufactured to receive, thereby reducing the overall weight of the skates at a minimal cost.

Of course, the runners 40 and 250 may also be manufactured having a particular shape adapted for a holder specially manufactured to retain the runner 40 and 250, and not necessarily adapted to retain a typical all-steel blade.

The embodiments described above are intended to be exemplary. Those skilled in the art will therefore appreciate that the foregoing description is illustrative only, and that various alternate configurations and modifications can be devised without departing from the spirit of the present disclosure. For example, elements from different embodiments can be combined in a same runner. Accordingly, the present object is intended to embrace all such alternate configurations, modifications and variances which fall within the scope of the appended claims.

The invention claimed is:

1. An ice skate runner for detachable engagement in a blade holder of an ice skate, the blade holder having an opening therein for receiving at least a portion of the runner and mounting points to retain the runner in place, the runner comprising:

an upper polymeric portion shaped to be partially received within the opening of the blade holder;

a lower portion bonded to the upper portion and having a greater density than that of the upper portion, the lower portion defining a blade surface for engaging the ice; and at least one of the upper and lower portions being shaped to removably engage the mounting points;

wherein the runner has a total height defined perpendicularly to the blade surface, and includes at least one section where the runner is defined by the upper polymeric portion and is free of the lower portion along a majority of the total height, the at least one section extending longitudinally along a major part of a length of the runner.

2. The runner of claim 1, wherein in the at least one section a first height of the upper polymeric portion above the lower portion is greater than a second height of the upper polymeric portion which overlaps the lower portion.

3. The runner of claim 1, wherein the lower portion has a transverse thickness that is substantially constant.

4. The ice skate runner as defined in claim 3, wherein the part of the upper polymeric portion shaped to be received within the opening of the blade holder has a thickness at most equal to that of the lower portion.

5. The runner of claim 1, wherein the upper polymeric portion includes lateral ridges protruding laterally beyond the lower portion and shaped to abut the blade holder.

6. The ice skate runner as defined in claim 5, wherein the upper polymeric portion includes a center body extending upwardly from the lower portion to be received in the opening of the blade holder, and the lateral ridges extend transversally away from the center body and are integrally formed therewith such that the upper portion defines a cruciform shape along at least a majority of a total length of the runner.

7. The ice skate runner as defined in claim 6, wherein the at least one of the upper and lower portions is shaped to removably engage the mounting points by including at least two spaced apart mounting members, the upper polymeric portion including reinforcement regions proximate the mounting members, the reinforcement regions including additional material extending between the center body and the lateral ridges from an underside thereof.

8. The runner of claim 1, wherein the upper polymeric portion has an elongated slot defined in a base thereof, the slot receiving the lower portion therein and having a depth which is less than half of a total height of the lower portion.

9. The runner of claim 1, wherein the lower portion includes an elongated body extending between front and rear curved ends and at least one discrete tongue portion upstanding from the elongated body, the tongue portion being engaged with the polymeric portion, the at least one section including at least two sections spaced apart by the at least one tongue portion.

10. The runner of claim 9, wherein two discrete upstanding tongue portions are disposed at longitudinally spaced apart locations on the elongated body of the lower portion, one of the at least one section being defined between the two tongue portions.

11. The runner of claim 1, wherein the runner includes an upstanding mounting member disposed proximate each of opposed ends of the runner, the mounting members being configured to engage the mounting points of the blade holder.

12. The runner of claim 11, wherein each upstanding mounting member is defined by the lower portion and extends apart from the at least one section.

13. The runner of claim 1, wherein the lower portion defines smooth, planar side surfaces.

14. The runner of claim 1, wherein the upper polymeric portion defines a cruciform-shaped cross-sectional profile along at least a portion of a length thereof.

15. The runner of claim 14, wherein the cruciform-shaped cross-sectional profile extends along a majority of the length of the upper polymeric portion.

16. The ice skate runner as defined in claim 1, wherein the at least one of the upper and lower portions is shaped to removably engage the mounting points by including at least two spaced apart mounting members each having a mounting opening transversally defined therein for receiving a transversally extending fastener.

17. The ice skate runner as defined in claim 16, wherein the lower portion includes the at least two spaced apart mounting members extending integrally therefrom, each mounting member including a top rounded portion having the mounting opening defined therein and having a slot extending from the mounting opening to a top edge of the rounded portion such that the fastener is slidable in the mounting opening through the slot.

18. The ice skate runner as defined in claim 16, wherein the lower portion includes the at least two spaced apart mounting members extending integrally therefrom, a top portion of each mounting member protruding upwardly from the upper portion and being free therefrom.

19. An ice skate comprising:

a skate boot;

a holder having a top surface attached to an underside of the skate boot and a bottom surface with an elongated opening defined therein and front and rear mounting points; and a replaceable runner detachably engaged to the holder at said front and rear mounting points and having a portion thereof received within the elongated opening, the runner having a metal blade and an upper polymeric portion bonded to the blade along an elongated body of the blade, the elongated body extending between front and rear curved ends, two mounting members being upstanding from the elongated body and disposed proximate the front and rear curved ends, the mounting members being engaged with the front and rear mounting points of the holder for detachably fastening the runner thereto, the upper polymeric portion including a central upper ridge which is received within the elongated opening of the holder and defining a slot formed in a base thereof within which at least a portion of the blade body is received, and wherein a first height of the polymeric portion above the blade is greater than a second height of the polymeric portion which overlaps the blade, and the runner includes at least one section free of the metal blade along a majority of a total height of the runner, the at least one section extending longitudinally along a major part of a length of the runner.

20. The ice skate as defined in claim 19, wherein each mounting member is defined as part of the metal blade extends apart from the at least one section.

21. The ice skate as defined in claim 19, further comprising at least one detachable fastener selectively retaining one of the two mounting members of the replaceable runner to the corresponding one of the front and rear mounting points of the holder.

22. A replaceable runner for an ice skate comprising:

a metal blade having an elongated body extending between front and rear curved ends, at least one mounting member disposed on the elongated body proximate each of the front and rear curved ends, the mounting members being configured for fastening engagement with the ice skate; and an upper polymeric portion bonded to the blade along the elongated body thereof, the upper polymeric portion having a slot defined in a base thereof within which at least a portion of the blade body is received, and wherein the runner includes at least one section free of the metal blade along a majority of a total height of the runner, the at least one section extending longitudinally along a major part of a length of the runner.

23. The replaceable runner as defined in claim 22, wherein a first height of the polymeric portion above the blade is greater than a second height of the polymeric portion which overlaps the blade.

24. The replaceable runner as defined in claim 22, wherein the slot in the polymeric portion which receives the blade body has a depth which is less than half of a height of the blade body.

25. The replaceable runner as defined in claim 22, wherein the blade includes at least one discrete tongue portion upstanding from the elongated body of the blade at a longitudinal point thereon between said mounting members, the tongue portion being engaged with the polymeric portion, the at least one section being defined spaced apart from the at least one tongue portion.

26. The replaceable runner as defined in claim 22, wherein the elongated body of the blade defines un-interrupted planar side surfaces.

27. The replaceable runner as defined in claim 22, wherein at least the elongated body of the blade has a constant transverse thickness.

28. The replaceable runner as defined in claim 27, wherein the entire blade has said constant transverse thickness.

29. The replaceable runner as defined in claim 22, wherein the polymeric portion defines a cruciform-shaped cross-sectional profile along at least a portion of a length thereof.

30. The replaceable runner as defined in claim 29, wherein the cruciform-shaped cross-sectional profile extends along a majority of the length of the polymeric portion.

31. The replaceable runner as defined in claim 22, wherein the upper polymeric portion extends along a majority of a length of the runner.

* * * * *